US009822586B2

(12) United States Patent
Patron et al.

(10) Patent No.: US 9,822,586 B2
(45) Date of Patent: Nov. 21, 2017

(54) DEVICE FOR ASSISTING IN THE RAISING AND/OR LOWERING OF A PERSON

(71) Applicant: FIXATOR, St Barthelemy d'Anjou (FR)

(72) Inventors: Bruno Patron, Juigne sur Loire (FR); Myrtil Ouvrard, Andard (FR); Olivier Coutable, Angers (FR); Mickael Rivette, Bar le Duc (FR); Jean-Marie Beaumont, Saint Lambert la Potherie (FR)

(73) Assignee: FIXATOR, St. Barthelemy d'anjou (FR)

( * ) Notice: Subject to any disclaimer, the term of this patent is extended or adjusted under 35 U.S.C. 154(b) by 0 days.

(21) Appl. No.: 14/764,300

(22) PCT Filed: Jan. 27, 2014

(86) PCT No.: PCT/FR2014/050146
§ 371 (c)(1),
(2) Date: Jul. 29, 2015

(87) PCT Pub. No.: WO2014/118460
PCT Pub. Date: Aug. 7, 2014

(65) Prior Publication Data

US 2015/0368972 A1 Dec. 24, 2015

(30) Foreign Application Priority Data

Jan. 29, 2013 (FR) ..... 13 50714

(51) Int. Cl.
*E06C 7/12* (2006.01)
*E06C 7/18* (2006.01)

(52) U.S. Cl.
CPC ..... *E06C 7/12* (2013.01); *E06C 7/18* (2013.01); *E06C 7/186* (2013.01)

(58) Field of Classification Search
CPC ..... A62B 1/10; E06C 7/12; E06C 7/18; E06C 7/186
See application file for complete search history.

(56) References Cited

U.S. PATENT DOCUMENTS 7,004,288 B2 * 2/2006 Araki ..... E06C 7/12 182/103
7,546,902 B2 * 6/2009 Schwertner ..... B66B 9/193 182/103

(Continued)

FOREIGN PATENT DOCUMENTS

DE 20 2004 004 117 U1 5/2004
DE 102005044922 A1 * 4/2007 ..... E06C 7/12

(Continued)

OTHER PUBLICATIONS

International Search Report, dated Mar. 5, 2014, from corresponding PCT application.

*Primary Examiner* — Colleen M Chavchavadze
(74) *Attorney, Agent, or Firm* — IPSILON USA

(57) ABSTRACT

A device (1) for assisting a person in climbing up and/or down, includes: a box (2); a link (3) suitable for passing through the box (2), the link (3) preferably being equipped at or in the vicinity of each of its ends with at least one member (4) for securing to a support, along which the box (2) is to be moved; drive elements equipped with variable speed drive and configured to drive the box (2) so as to move it at an adjustable speed along the link (3); attachment elements (6) for attaching the box (2) to an operator (13); force measurement elements suitable for measuring the traction force exerted by the operator (13) on the attachment elements (6); and control elements for controlling operation of the drive elements so that they operate at a speed regulated as a function at least of the measurement.

13 Claims, 4 Drawing Sheets

(56) References Cited

U.S. PATENT DOCUMENTS

| | | | | |
|---|---|---|---|---|
| 7,900,745 | B1 * | 3/2011 | Tindal | E06C 7/16 182/103 |
| 7,909,139 | B2 * | 3/2011 | Blue | A01M 31/02 182/103 |
| 7,987,945 | B2 * | 8/2011 | Petersen | E06C 7/186 182/43 |
| 8,316,994 | B1 * | 11/2012 | Rands | B66B 9/187 182/141 |
| 8,763,757 | B2 * | 7/2014 | Zwirn | E06C 7/16 182/103 |
| 8,887,865 | B2 * | 11/2014 | Matharu | E06C 7/186 182/8 |
| 8,974,334 | B2 * | 3/2015 | Stephenson | B66D 1/7405 182/107 |
| 2008/0142298 | A1 | 6/2008 | Blasek | |
| 2010/0219016 | A1 * | 9/2010 | Meillet | E06C 7/186 182/8 |
| 2011/0048853 | A1 | 3/2011 | Brickell | |
| 2015/0273250 | A1 * | 10/2015 | Bina | A62B 99/00 182/8 |

FOREIGN PATENT DOCUMENTS

| | | | | |
|---|---|---|---|---|
| DK | WO 03002447 | A1 * | 1/2003 | B66B 5/005 |
| WO | 2005/088063 | A1 | 9/2005 | |

* cited by examiner

DEVICE FOR ASSISTING IN THE RAISING AND/OR LOWERING OF A PERSON

The present invention relates to a device for assisting a person in climbing up and/or down.

The present invention relates more particularly to a device for assisting a person in climbing up and/or down, the device being of the type comprising:

a box;

a link suitable for passing through said box, said link preferably being equipped at or in the vicinity of each of its ends with at least one member for securing to a support, such as a ladder, along which the box is to be moved;

drive means equipped with variable speed drive, said drive means that are carried by said box being configured to drive the box so as to move it at an adjustable speed along said link; and attachment means for attaching the box to an operator or to safety equipment worn by said operator so as to make it possible, as the box moves, to assist the operator in moving.

Such devices are already known and they offer the advantage of being able to be fitted to a large number of different supports. However, currently, in such devices, although the speed of movement along the link can be adjustable as a function of the weight of the user, once adjusted, said speed is kept constant over the entire up or down travel. As a result there is a risk of the operator being lifted, which is not desirable, and a risk of operation being rather violent with the box being moved jerkily.

Such devices for assisting in climbing up or down, and in which the box is mounted to move back and forth along the link, which is stationary, should not be confused with devices of the type of those described in Documents WO 2005/088063, US 2011/048853, and DE-20 2004 004117, in which documents the link is a moving link, and the box is mounted to be stationary relative to the link. In such devices in which the link is a moving link, said link is generally in the form of an endless loop, and the measurement means sense the movements of the link, thereby generally leading to a measurement being taken at the drive means for driving the link, which drive means are remote from the operator. As a result, the measurement is inaccurate relative to the behavior of the operator.

An object of the present invention is thus to propose a device that is of design enabling the box to be moved smoothly and gently along the link, it being possible for this movement to be continuously adapted to the behavior of the operator.

Another object of the present invention is to provide a device that is of simplified design, making it possible for the drive means for moving the box to be controlled safely under all circumstances.

To these ends, the invention provides a device for assisting a person in climbing up and/or down, the device being of the type comprising:

a box;

a link suitable for passing through said box, said link preferably being equipped at or in the vicinity of each of its ends with at least one member for securing to a support, such as a ladder, along which the box is to be moved;

drive means equipped with variable speed drive, said drive means that are carried by said box being configured to drive the box so as to move it at an adjustable speed along said link; and attachment means for attaching the box to an operator or to safety equipment worn by said operator so as to make it possible, as the box moves, to assist the operator in moving;

the device being characterized in that it further comprises force measurement means suitable for measuring the traction force exerted by the operator on the attachment means, and control means for controlling operation of the drive means so that they operate at a speed regulated as a function at least of said measurement.

By means of the facts that the link is a stationary link, that the box is driven via the drive means back and forth along the link, and that the measurement means can be positioned in the immediate vicinity of the box, the results of the measurement can be transmitted over a wired connection to the drive means carried by the box. Such a wired connection makes it possible to guarantee that the drive means operate safely as a function of the measurement. They also enable the installation to be compact, and the measurement to be simpler to take. In addition, locating the measurement means in the vicinity of the drive means guarantees that the measurement is accurate.

By means of the fact that the control means for controlling operation of the drive means are configured to cause the drive means to operate at a speed that is continuously regulated as a function of the traction force exerted by the operator on the attachment means, said box adapts to the movements of the operator so as to avoid lifting the operator and so as to avoid exerting a violent traction force on the operator while the operator is climbing up, or so as to avoid going faster than the operator while the operator is climbing down. Thus, the box goes faster than the operator while the operator is climbing up so as to act by traction on the operator, while it tends to restrain the operator while the operator is climbing down.

Preferably, the force measurement means are disposed at the attachment means and/or at the zone in which the box is connected to said attachment means.

Preferably, the attachment means comprise first attachment means for attaching to the box, second attachment means for attaching to the operator or to safety equipment worn by the operator, and connection means for connecting together said first attachment means and said second attachment means, and the force measurement means are disposed at the first attachment means and/or at the second attachment means and/or at the connection means for connecting together said first and second attachment means.

Preferably, the connection means for connecting together the first and second attachment means are means of the optionally elastically deformable link type.

By means of this provision, the drive by the box for moving the operator can be damped and therefore be more gentle.

Preferably, the first attachment means comprise at least one pin fastened to the box and to which said connection means are coupled, and the force measurement means comprise at least one dynamometric pin, said pin being incorporated into said first attachment means.

In this provision, the force measurement means form the first attachment means. As a result the overall assembly is simplified.

Preferably, said drive means for moving the box along said link comprise at least one drive wheel around which the link is suitable for winding partially, and at least two auxiliary presser wheels, each of which co-operates with the drive wheel to define a zone in which the link is nipped and is pressed against the periphery of the drive wheel, said drive wheel and the auxiliary wheels preferably being disposed inside the box.

The drive wheel is thus equipped with rotary drive means for moving the box along the link when the wheel is in the state in which it is driven in rotation.

Preferably, the drive means have two drive directions, and the device includes a drive direction selector for selecting the drive direction of the drive means, one direction corresponding to the climb-up mode, and the other corresponding to the climb-down mode.

Preferably, the device includes memory means for storing at least one maximum force threshold value and one minimum force threshold value, comparator means for comparing the value of the force measurement with the maximum force threshold value, said control means for controlling operation of the drive means for moving the box along said link being configured so that, within the range defined by said threshold values, they cause said drive means to operate at a speed regulated as a function of the value of the difference between the value of the measurement and the maximum force threshold value and as a function of the selected mode (climb-up mode/climbing down mode).

When choosing the speed of the drive means, the fact that account is taken of the difference between the maximum force threshold value and the value of the measurement makes it possible to avoid violent and jerky movement of the box.

Preferably, in the climb-down mode, the control means for controlling operation of the drive means for moving the box along said link are configured so that, within the range defined by said threshold values, and over at least a fraction of said range, they cause the speed to increase when the measurement value increases.

In the climb-up mode, the control means for controlling operation of the drive means for moving the box along said link are configured so that, within the range defined by said threshold values, and over at least a fraction of said range, they cause the speed to increase when the measurement value decreases.

The box thus adapts well to the behavior of the operator who, on exerting a large traction force on the attachment means, sees the speed of the box regulated in variable manner depending on whether the device is moving up or moving down.

Preferably, the box is made up of a body and of a lid for giving access to the inside of the box, and the auxiliary wheels are carried by one of the lid and of the box, and the drive wheel is carried by the other one of the box and of the lid.

This configuration facilitates installing and removing the link.

The invention can be well understood on reading the following description of embodiments given with reference to the accompanying drawings, in which.

Figure 1:
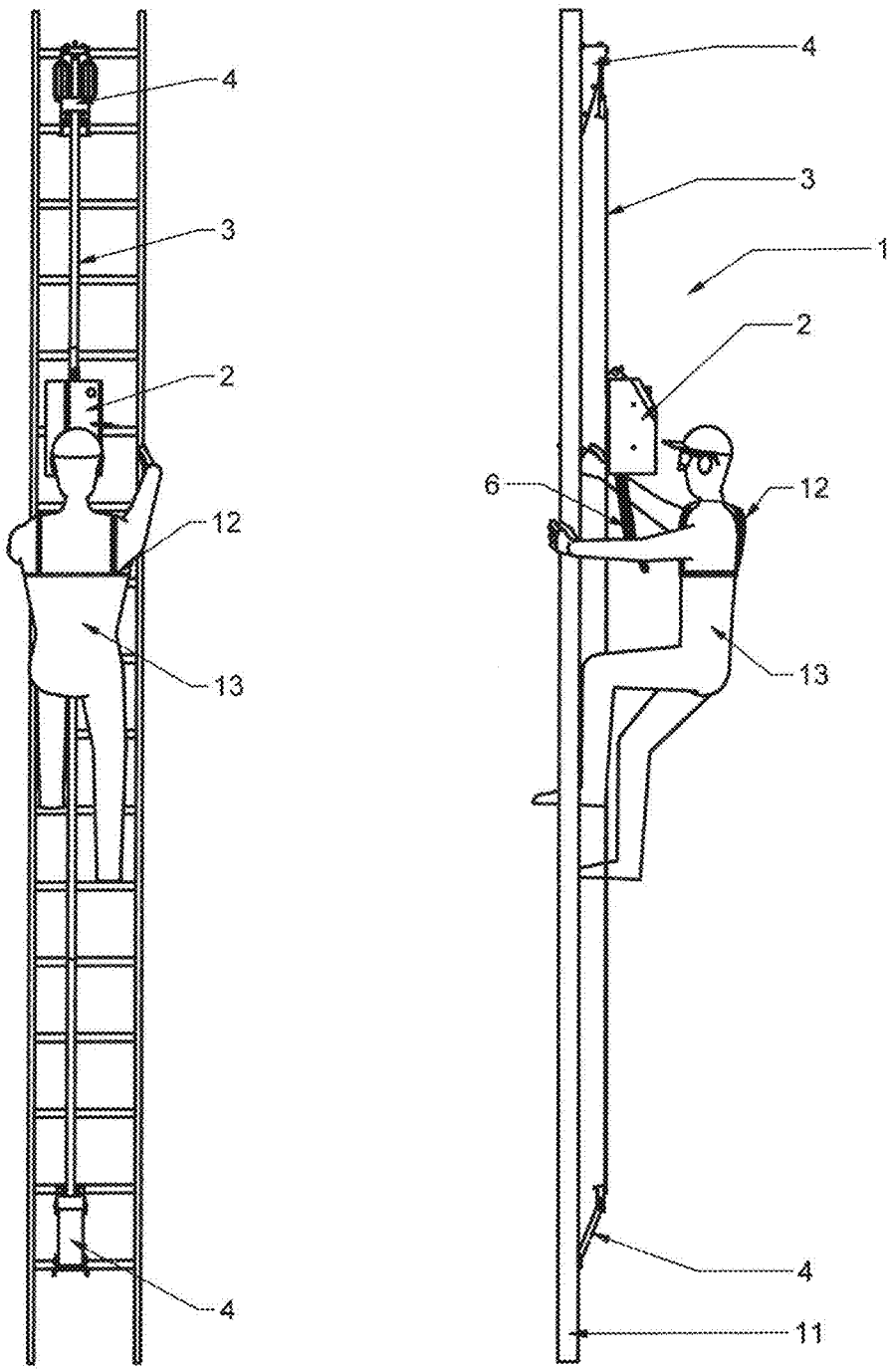
FIG. 1 shows a front view and a side view of a device of the invention in the state in which it is installed on a ladder.
Figure 4:
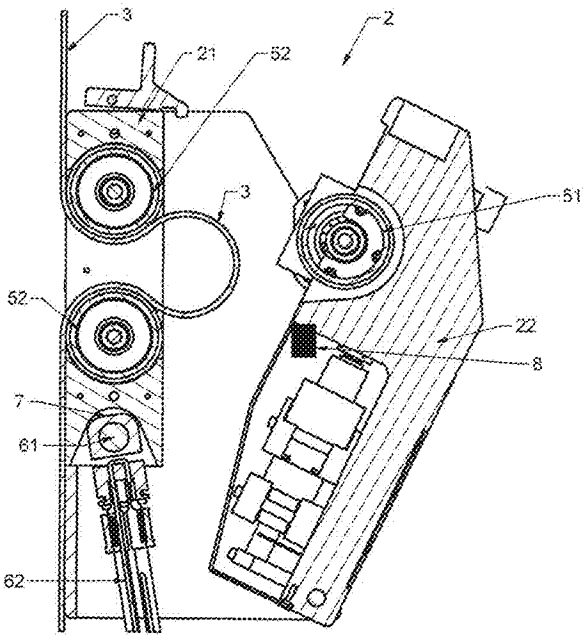
Figure 3:
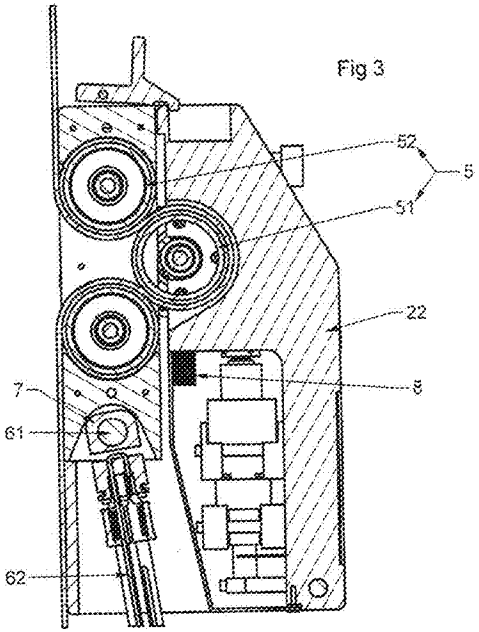
Figure 2:
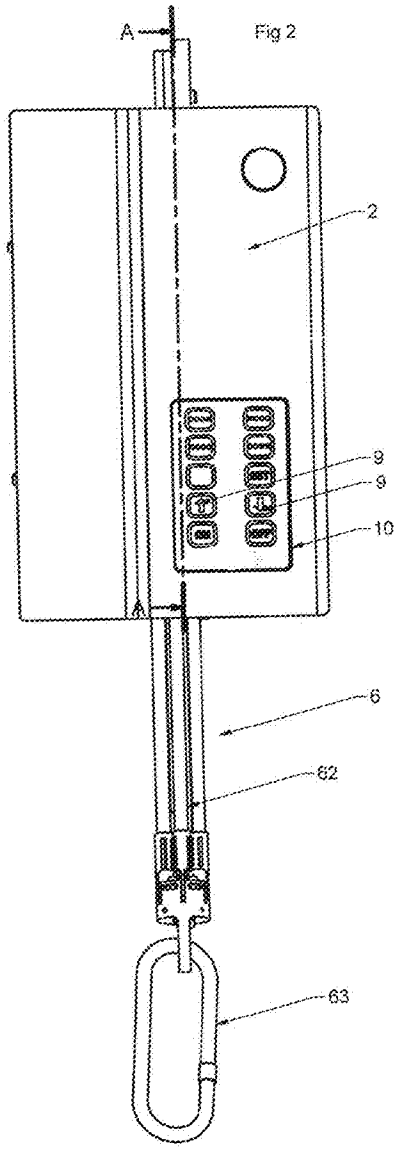
FIG. 2 is a front view of the device.
Figure 5:
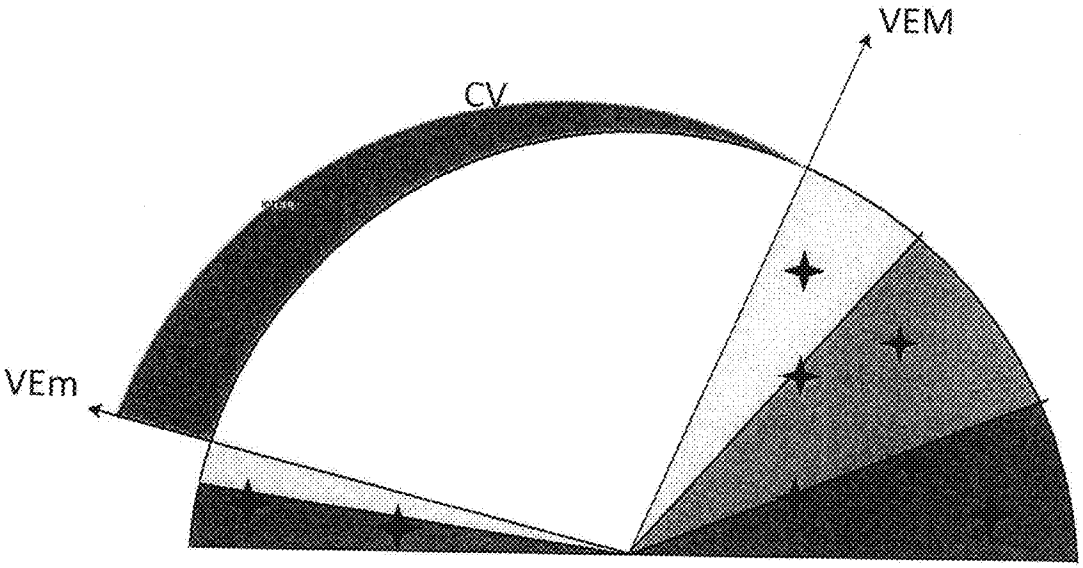
Figure 6:
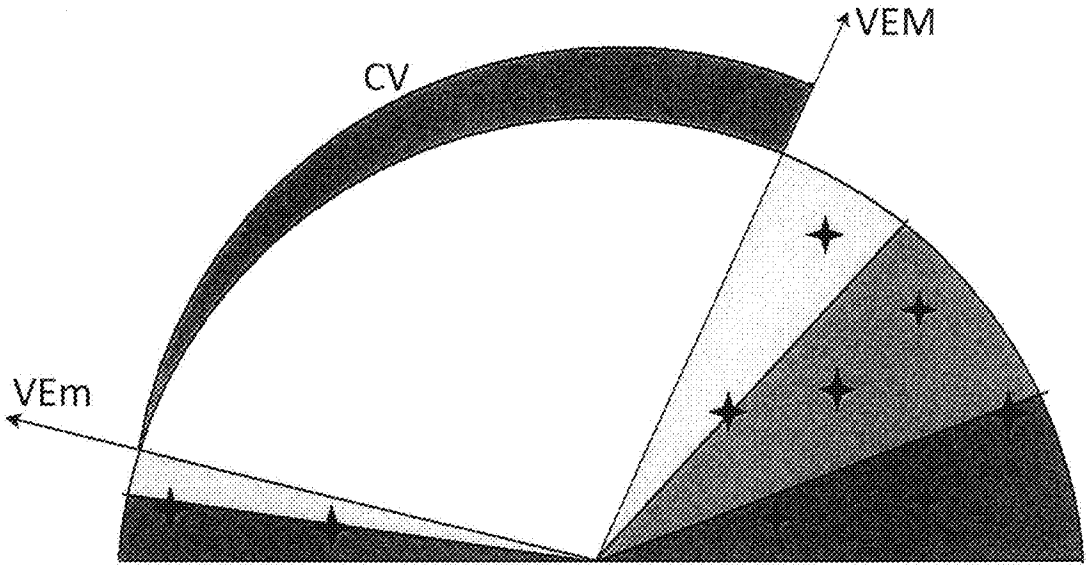

FIGS. 3 and 4 are longitudinal section views of the device shown in the state in which the box is closed (FIG. 3) and in the state in which the box is open (FIG. 4); and FIGS. 5 and 6 are diagrammatic views showing the variation in the speed setpoint for the drive means as a function of the value for the difference between the maximum force threshold value and the measured force value, FIG. 5 corresponding to the climb-up mode, and FIG. 6 to the climb-down mode.

As mentioned above, the device 1 of the invention is more particularly designed to assist a person in climbing up or down a support, and, in this example, up or down a ladder 11.

Said device 1 comprises, in a manner known per se:

- a box 2;
- a link 3 suitable for passing through said box 2;
- drive means 5 equipped with variable speed drive and configured to drive the box 2 so as to move it at an adjustable speed along said link 3; and
- attachment means 6 for attaching the box 2 to an operator 13 or to safety equipment 12 worn by said operator 13 so as to make it possible, as the box 2 moves, to assist the operator 13 in moving.

In the example, shown, the box 2 is generally in the shape of a rectangular block, and is made up of a body 21 and of a lid 22 mounted to pivot on the body 21 to go between an open position and a closed position of the box.

Said box houses the drive means 5 for driving the box 2 so as to move it along the link 3. Said drive means 5 comprise a drive wheel 51 and two auxiliary wheels 52 that are not motor-driven.

The drive wheel 51 and the auxiliary wheels 52 have parallel axes of rotation. The drive wheel 51 is disposed between said auxiliary wheels 52, which are presser wheels, and co-operates with said auxiliary wheels to form an S-shaped path followed by the link 3, which is thus nipped between each auxiliary wheel and the drive wheel.

The function of each auxiliary wheel is to keep the link pressing against the periphery of the drive wheel as it winds partially around said drive wheel.

Said link 3 is a strap that may be notched or otherwise. Said link 3 is equipped at each of its ends with a member 4, such as a snap-hook or "karabiner", for securing the ends of said link 3 to the ladder 11. Thus, one of the ends of the link is secured by a securing member 4 to the top of the ladder, while the other end of the link is secured by another securing member 4 to the bottom end of the ladder.

Thus, when the link 3 is the state in which it is attached to ladder 11, and when the drive wheel 51 is driven in rotation by the drive means 5, said drive wheel moves along the link 3 either in the up direction along said link, or in the down direction along said link, depending on the direction of rotary drive selected for said drive wheel.

The drive means for driving the drive wheel in rotation comprise a reversible motor having two operating directions, one enabling the drive wheel to be rotated in a direction corresponding to box moving up the link, and the other enabling the drive wheel to be rotated in a direction corresponding to the box moving down said link. It is the operator 13 who selects the drive direction of the drive means 5 by using a selector 9.

To this end, the box is equipped, for example, on its front, with a keypad 10 or a control screen having means such as buttons, keys, and windows for selecting the drive direction of the drive means 5.

The device is further provided with attachment means 6 for attaching the box 2 to an operator 13 or to safety equipment 12 worn by said operator. In the example shown, the operator is wearing safety equipment 12 formed by a harness.

The attachment means 6 comprise a tension adjuster 62 equipped at one end with a pin 61 for attaching the tension adjuster to the box and at the other end with a snap-hook 63 for attaching the tension adjuster to the harness.

The pin 61 is a dynamometric pin that firstly connects the tension adjuster to the box, and secondly measures the traction force exerted by the operator on said attachment means.

Naturally, the box could have been equipped, at the pin bearings, with a force sensor such as a strain gauge. However, the solution shown is characterized by its simplicity and by the resulting reduction in the number of parts.

The dynamometric pin thus forms the force measurement means 7 that are suitable for measuring the traction force exerted by the operator 13 on the attachment means 6.

The device further comprises control means for controlling operation of the drive means 5. Since the drive means 5 are equipped with variable speed drive, the control means 8 are configured to enable the speed of drive means 5 to be caused to vary. In this example, the control means 8 are configured to regulate the speed of the drive means 5 in particular as a function of the value of the traction force exerted by the operator on the attachment means 6.

Said control means 8 are formed by an electronic and computer processing and computation unit. Said unit may be implemented in the form of an electronic circuit provided with a microcontroller or with a microprocessor associated with a data storage memory.

Thus, when, in the description below, it is indicated that given means are configured to perform a given operation, that indicates that the electronic and computer system that forms said means includes computer instructions making it possible to perform said operation.

The device further comprises memory means for storing a minimum force threshold value VEm and a maximum force threshold value VEM. Said memory means may be incorporated in or be in communication with the control means.

Preferably the maximum force threshold VEM is determined by the device. The device further comprises:

- means for selecting a "calibration" mode;
- means for measuring the weight of the operator by lifting the operator by means of the link;
- means for storing in a memory the data stored during said lifting; and
- means for processing said data to define the maximum force threshold that corresponds to a traction force exerted on the attachment means of a value less than the traction force that would be exerted on the attachment means by the weight of the operator 13.

The weight of the operator may also be input by the operator directly into the device and stored in a memory by the device so as to be processed with a view to determining the maximum force threshold value by computation.

The device further comprises means for storing in a memory a minimum force threshold value VEm that is generally chosen independently of the weight of the operator. Said minimum force threshold value corresponds to a value greater than the traction force exerted without any load by the attachment means and the safety equipment on the box and detected by the force measurement means 7.

The device further includes means for comparing the value of the measurement with the maximum and minimum force threshold values.

The control means for controlling operation of the drive means for moving the box along said link are configured to cause said drive means to be off outside the range defined by said threshold values. These "off" zones within which the drive means are off are represented by crosses in FIGS. 5 and 6.

Within the range, the control means are configured to cause the drive means to operate at a speed that is a function at least of the value of the difference between the maximum force threshold value and the value of the measurement by the force measurement means 7, and as a function at least of the selected drive direction (climb-up mode or climb-down mode) in which the box is caused to move.

To this end, the device further comprises means for storing in a memory the force value measured by the force measurement means 7, means for computing the difference between the value of the measurement and the maximum force threshold value, and means for causing the control means to transmit a signal to the drive means 5 as a function of the value of the computed difference.

Thus, in climb-down mode, the control means for controlling operation of the drive means 5 for causing the box to move along said link are configured to control the speed to increase when the force measurement value increases, i.e. when the difference between the maximum force threshold value and the measurement value decreases.

In climb-up mode, the control means for controlling operation of the drive means 5 for causing the box to move along said link 3 are configured so that, within the range defined by said threshold values and over at least a fraction of the range, they control the speed to increase when the force measurement value decreases, i.e. when the difference between the maximum force threshold value and the measurement value increases.

This mode of control is shown in FIGS. 5 and 6, in which the speed setpoint value CV is shown in the form of a crescent moon, the thickness of which embodies the value of said speed setpoint. The thicker the crescent, the higher the speed setpoint.

It should thus be noted that, in FIG. 5, which shows the speed setpoint in the climb-up mode, the closer the measured force signal is to the maximum force threshold value, i.e. the smaller the difference between the measured force threshold value and the measured force value, the lower the speed of the drive means because a zone is reached beyond which operation of the drive means must be prevented to avoid the operator being lifted or to avoid breakage by overloading the drive means.

FIG. 6 shows the climb-down mode. Conversely, in climb-down mode, the closer the measured force signal is to the maximum force threshold value, the higher the speed of movement of the box in order to reduce the braking effect that could result from the action of the box on the operator via the attachment means, the box tending to restrain the operator and to brake the downward movement of said operator.

It should also be noted that the control means for controlling operation of the drive means for moving the box along said link are configured to cause the box to stop moving when the value of the difference between the maximum force threshold value and the measured value is constant for a predetermined period of time.

In the example shown, in order to facilitate installing or removing the link, the presser wheels 52 are carried by one of the box and of the lid and the drive wheel 51 is carried by the other one of the lid and of the box.

Energy storage accumulators, such as batteries, not shown, are also housed at least partially in the box in order to make it possible to obtain a portable device that operates in self-contained manner.

A device such as the above-described device thus operates as follows:

The operator puts on the harness and can also make an attachment to the ladder with an additional fall arrester device. The link 3 is fastened to the ladder at each of its ends. The box 2 through which the link 3 passes is in the bottom portion of the ladder.

The operator selects the "calibrate" mode on the box. The weight of the operator is measured by the force measurement sensor and, in this example, by the dynamometric pin, and the computed maximum force threshold value is stored in a memory.

The operator selects the "climb-up" mode. The operator manually exerts traction on the attachment means 6 that enables the box to move up the link until the box reaches a height relative to the operator that is sufficient to exert a traction force on the operator.

The speed at which the box is moved is then regulated as a function of the measured difference between the maximum force threshold value and the threshold value measured by the force measurement means 7 using the regulation relationship as described above, i.e. with a speed that decreases as the measured value comes closer to the maximum force threshold value.

It can thus be observed that the box comes to a stop gradually rather than suddenly, with a speed of execution of the movements of the box that is extremely rapid.

When the box is in the high position along the link, the travel of the box is ended by an end-of-travel detection stop that is disposed at the top end of the link.

The operator can then select the "climb-down" mode. Once again, the operator can initiate the downward movement of the box by pulling manually on the attachment means. The box continues to move down, moving at a speed that follows a regulation relationship complying with that shown, i.e. with a speed that increases when the measured force value increases to enable the box to follow the operator climbing down.

The increase in the drive speed at which the box is caused to move in the vicinity of the maximum force threshold speed makes it possible to reduce rapidly the traction measured under the attachment means, the box tending to move rapidly closer to the operator so as to limit the restraining force that could be exerted by the box on the operator while the operating is climbing down.

The invention claimed is:

1. A device for assisting a person in climbing up and/or down, the device comprising:

a box;

a link for passing through said box, said link equipped at, or in the vicinity of, each of its ends with at least one member for securing said link to a support along which the box is to be moved;

drives equipped with variable speed drives, said drives carried by said box configured to drive the box so as to move it at an adjustable speed along said link; and an attachment element for attaching the box to an operator or to safety equipment worn by said operator so as to make it possible, as the box moves, to assist the operator in moving;

said device further comprising force measurement device suitable for measuring the traction force exerted by the operator on the attachment element, and a controller for controlling operation of the drive so that they operate at a speed regulated as a function at least of said measurement.

2. The device according to claim 1, wherein the force measurement device is disposed at the attachment element and/or at the zone in which the box is connected to said attachment element.

3. The device according to claim 1, wherein a connection element that connects together the attachment element and said force measurement device is an elastically deformable link.

4. The device according to claim 1, wherein a first part of said attachment element is at least one pin fastened to the box and to which said connection element is coupled, and the force measurement device comprises at least one dynamometric pin, said pin being incorporated into said first attachment element.

5. The device according to claim 1, wherein said drive for moving the box along said link comprises at least one drive wheel around which the link is suitable for winding partially, and at least two auxiliary presser wheels, each of which co-operates with the drive wheel to define a zone in which the link is nipped and is pressed against the periphery of the drive wheel.

6. The device according to claim 1, wherein the drive has two drive directions, and in that the device includes a drive direction selector for selecting the drive direction of the drive, one direction corresponding to the climb-up mode, and the other corresponding to the climb-down mode.

7. The device according to claim 6, further including memory for storing at least one maximum force threshold value and one minimum force threshold value, a comparator for comparing the value of the measurement with the maximum force threshold value, said controller for controlling operation of the drive for moving the box along said link being configured so that, within the range defined by said threshold values, they cause said drive to operate at a speed regulated as a function of the value of the difference between the value of the measurements and the maximum force threshold value and as a function of the selected mode.

8. The device according to claim 7, wherein in the climb-down mode, the controller for controlling operation of the drive for moving the box along said link are configured so that, within the range defined by said threshold values, and over at least a fraction of said range, they cause the speed to increase when the force measurement value increases.

9. The device according to claim 7, wherein in the climb-up mode, the controller for controlling operation of the drive for moving the box along said link are configured so that, within the range defined by said threshold values, and over at least a fraction of said range, they cause the speed to increase when the force measurement value decreases.

10. The device according to claim 5, wherein the box is made up of a body and of a lid for giving access to the inside of the box, and in that the auxiliary wheels are carried by one of the lid and of the box, and the drive wheel is carried by the other one of the box and of the lid.

11. The device according to claim 3, wherein the attachment element comprises at least one pin fastened to the box and to which said connection element is coupled, and the force measurement device comprises at least one dynamometric pin, said pin being incorporated into said attachment element.

12. The device according to claim 1, wherein said at least one support is a ladder.

13. The device according to claim 5, wherein said drive wheel and the auxiliary wheels are disposed inside the box.

* * * * *